United States Patent [19]

Harris

[11] Patent Number: 4,926,590

[45] Date of Patent: May 22, 1990

[54] STAGING

[76] Inventor: Benjamin J. Harris, Elm Tree House, Wendlebury, England, 0X6 8PN

[21] Appl. No.: 328,501

[22] Filed: Mar. 24, 1989

[30] Foreign Application Priority Data

| | | | |
|---|---|---|---|
| Mar. 26, 1988 | [GB] | United Kingdom | 8807257 |
| Jul. 16, 1988 | [GB] | United Kingdom | 8817000 |
| Jan. 31, 1989 | [GB] | United Kingdom | 8902045 |

[51] Int. Cl.[5] ..... E04H 3/12

[52] U.S. Cl. ..... 52/8; 52/645; 52/646; 52/648

[58] Field of Search ..... 52/645, 749, 637, 8–10, 52/638, 646, 648; 403/403; 182/180

[56] References Cited

U.S. PATENT DOCUMENTS

| | | | |
|---|---|---|---|
| 1,115,559 | 11/1914 | Mills | 182/180 |
| 1,460,267 | 6/1923 | Oberderfer | 403/403 |
| 1,839,679 | 1/1932 | Hoppes | 52/8 |
| 2,651,081 | 9/1953 | Storer | 52/8 |
| 4,023,686 | 5/1977 | Papsco et al. | 52/749 |
| 4,747,238 | 5/1988 | Wikstrom et al. | 52/8 |

FOREIGN PATENT DOCUMENTS

| | | | |
|---|---|---|---|
| 414829 | 8/1946 | Italy | 52/645 |
| 695774 | 8/1953 | United Kingdom . | |

*Primary Examiner*—James L. Ridgill, Jr.

*Attorney, Agent, or Firm*—Fleit, Jacobson, Cohn, Price, Holman & Stern

[57] ABSTRACT

Staging particularly for use in group photography comprises spaced support assemblies each comprising a rearwardly inclined truss member 151 supported by a first pair of legs 156, 157 arranged in a inverted-V configuration. The truss member 151 carries support brackets 155 for decking members (not shown) which bridge the truss assemblies in a stepped configuration. A bracing bar 158 joins the lower ends of the legs 156, 157, from which a pair of tie bars 159, 160 extend to the front end of the truss member 151. The upper end of the truss member is supported by a second pair of legs 165, 166 which are also arranged in an inverted-V configuration, and the lower ends of these legs are connected to the lower ends of the first pair of legs 156, 157.

14 Claims, 14 Drawing Sheets

STAGING

BACKGROUND OF THE INVENTION

1. Field of the Invention

This invention is concerned with staging of the type comprising a plurality of decking members arranged in a stepped configuration for supporting a group of people such as in group photography or a standing or seated audience.

2. Description of the Prior Art

Existing staging structures are heavy and bulky to transport and are slow and difficult to erect, particularly on uneven or sloping ground. For example, in one such structure each decking member is supported by two or more timber trestles which must each be individually erected and levelled. In other existing staging the decking members are supported by a scaffolding arrangement comprising numerous bars, clamps and other components which must all be connected together. That structure also has many individually adjustable feet which must all be correctly adjusted to avoid potentially dangerous stresses being produced in the structure. There is also a large wooden structure in commercial use which requires a team of erectors and a fleet of about seven lorries to transport it.

U.S. Pat. No. 4,747,238 discloses portable audience seating in which the decking members are supported by spaced rearwardly inclined truss members. Each truss member is in turn supported by spaced pairs of props or legs arranged in an inverted-V configuration, and the lower ends of each pair of legs are joined by a bracing bar. However, since the legs are not positively connected to the truss members such an arrangement would not be feasible for supporting trusses with a steep inclination of around 45 degrees such as is required for group photography. Moreover, each pair of legs must be individually and accurately levelled to prevent undesirable stresses from being produced in the truss members.

U.S. Pat. No. 1,839,679 discloses a similar form of staging, but here each pair of legs is positively connected to the respective truss member at their upper ends, and a single tie bar connects the centre of each bracing bar to the bottom of the respective truss. Whilst the structural strength and stability of such an arrangement may be better than that of U.S. Pat. No. 4,747,238, it is still considered that such an arrangement would not be acceptable for tall structures with steeply inclined truss members. Similar considerations apply to the structures disclosed in U.S. Pat. No. 2,651,081 and British Patent No. 695,774.

BRIEF SUMMARY OF THE INVENTION

An overall consideration in the development of the present staging has been to provide a form of staging which is quick and simple to erect even on uneven ground, which up to about seven rows can be erected by one man alone, and up to about eleven rows can be erected by just two men, and which above all is stable under normal conditions of use.

According to a first aspect the present invention provides staging comprising:

a pair of mutually spaced support assemblies, each support assembly comprising, a truss member having front and rear ends, a first pair of legs arranged in an inverted-V configuration to support said truss member with a rearward inclination, upwardly, each leg of said first pair of legs having upper and lower ends, first connection means positively connecting said first pair of legs to said truss member to prevent movement of said legs longitudinally of said truss member, bracing means for determining the spacing of said lower ends of said first pair of legs, and a pair of tie bars each linking said lower end of a respective leg of said first pair of legs with said front end of said truss member; and a plurality of decking members bridging said truss members of said support assemblies in a stepped configuration.

This basic structure can be used to provide a lightweight easily erectable staging up to about five rows of decking. Furthermore, as will be explained below, the structure can be extended to provide up to about eleven rows whilst still retaining the important features of ease of assembly and stability.

The use of dual tie bars accurately determines the location of the legs relative to the front end of the respective truss. In addition to minimising possible misalignment problems during assembly this ensures that the structure is considerably less likely to become unstable should it be subject to lateral forces that might cause displacement of the feet, e.g. due to high winds or misuse.

If it is required to use a longer truss member for supporting a larger number of decks, say up to fifteen feet or so in length, the upper portion of each truss member is preferably supported by a further pair of legs arranged in an invered-V configuration, the lower ends of which are connected with the lower ends of the first pair of legs.

The use of common feet for the two pairs of legs has been found to have several positive advantages over an arrangement in which the two pairs stand on separate feet. The task of levelling three feet is considerably easier than that of levelling five feet. Also, from an engineering point of view this is far superior since it ensures that both the mid and top regions of the truss member are equally supported and the risk of undesirable stresses or instability being produced in the structure is far less should one or more of the feet sink into soft ground for example. For the same reason the first pair of legs are preferably permanently connected to the respective tie rods so that they cannot be omitted from the structure under any circumstances.

According to a second aspect the invention provides staging comprising;

a pair of mutually spaced truss members;

means for supporting said truss members with a rearward inclination, upwardly;

a plurality of decking support members secured to each of said truss members at spaced positions along the length thereof;

a plurality of decking members bridging said truss members in a stepped configuration, each decking member having opposite end portions, and each of said end portions being seated upon one of said decking support members;

fifth connection means positively connecting said end portion of said decking member with said support portion, said firth connection means comprising a hook member secured to one of said end portion and said support portion, said hook member including a limb projecting transversely of said decking member, and an engaging portion associated with the other of said support portion and said end portion, the arrangement being such that said engaging portion engages said limb of said hook member to limit lifting of the decking member in an upward direction.

According to a third aspect the invention provides staging comprising:

a pair of mutually spaced box-section truss members;

means for supporting said truss members with a rearward inclination upwardly, each truss member having an open upper end forming a socket;

a plurality of decking members bridging said truss members in a stepped configuration; and a respective baluster upstanding from the upper end of each truss member for supporting guard rails extending transversely to the balusters, each baluster having a spigot which is axially received in said socket of said respective truss member.

According to a fourth aspect the invention provides a set of at least two stackable spacer elements for use in levelling a staging structure, each of said stacked element other than the lowermost of said stacked elements being of smaller width than the stacked element immediately below it, an upper surface of each element being provided with location means for engagement with and lateral location of a foot of said staging structure, and opposed upper and lower faces of each adjacent pair of spacer elements being adapted for relative lateral location of said adjacent pair of spacer elements.

BRIEF DESCRIPTION OF THE DRAWINGS

The invention is exemplified in the accompanying drawings, wherein.

DETAILED DESCRIPTION

Figure 1:
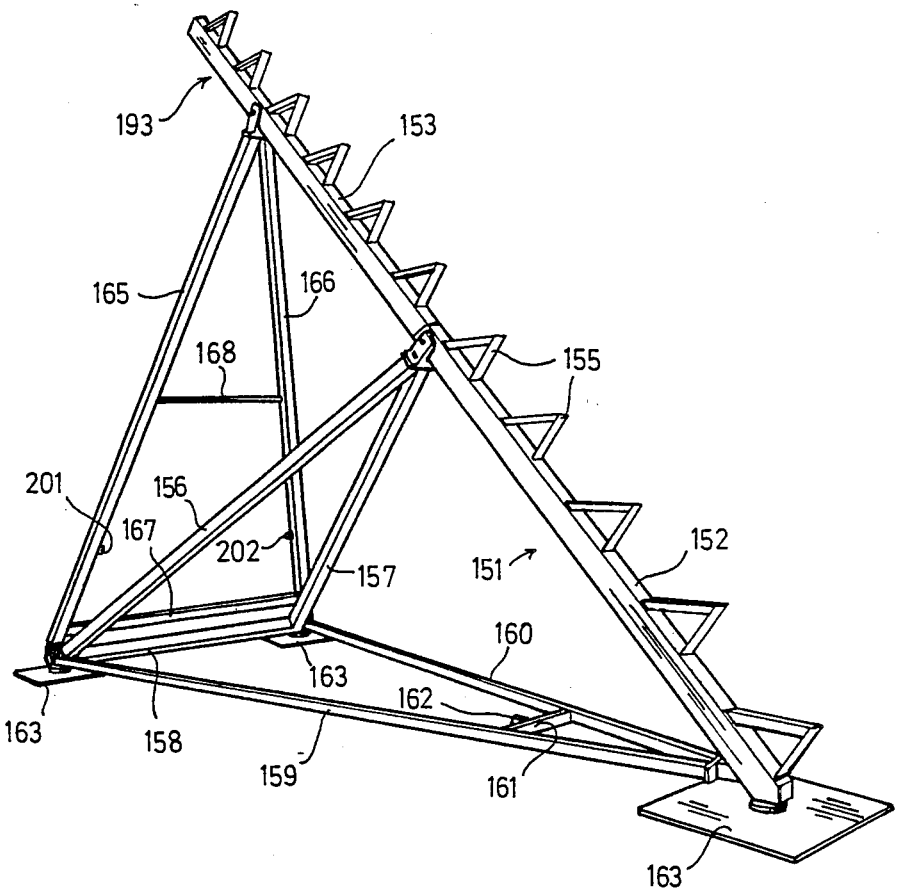
FIG. 1 is a perspective view of a single truss assembly for use in staging in accordance with the invention.

Referring to FIG. 1, the truss member 151 is of rectangular box section and comprises a lower section 152, and an upper section 153. The upper surfaces of the truss sections carry a series of longitudinally spaced V-shaped brackets 155 for supporting decking members, the lower section carrying five brackets and the upper section six brackets. The lower truss section 152 is rearwardly inclined and is supported at its upper end by a forwardly inclined first pair of legs 156, 157 arranged in an inverted-V configuration. The bottom ends of the legs are bridged by a bracing bar 158 to accurately determine their spacing. From each end of the bracing bar a respective tie bar 159, 160 extends forwardly to join the lower end of the truss. Towards their forward ends a cross bar 161 is welded to both tie bars 159, 160. An apertured plate 162 extends rearwardly from the centre of the cross bar, the purpose of which will be explained below. The lower ends of legs 156, 157 and of the truss 151 are each supported on respective ground plates 163.

The upper truss section 153 is supported part way along its length by a second forwardly inclined pair of legs 165, 166 which are again arranged in an inverted-V configuration. The lower ends of these legs are connected with the lower ends of the first pair of legs in a manner to be described, and they are bridged by a bracing bar 167. These rear legs 165, 166 are also bridged part way along their length by a further bracing bar 168.

Figure 2:
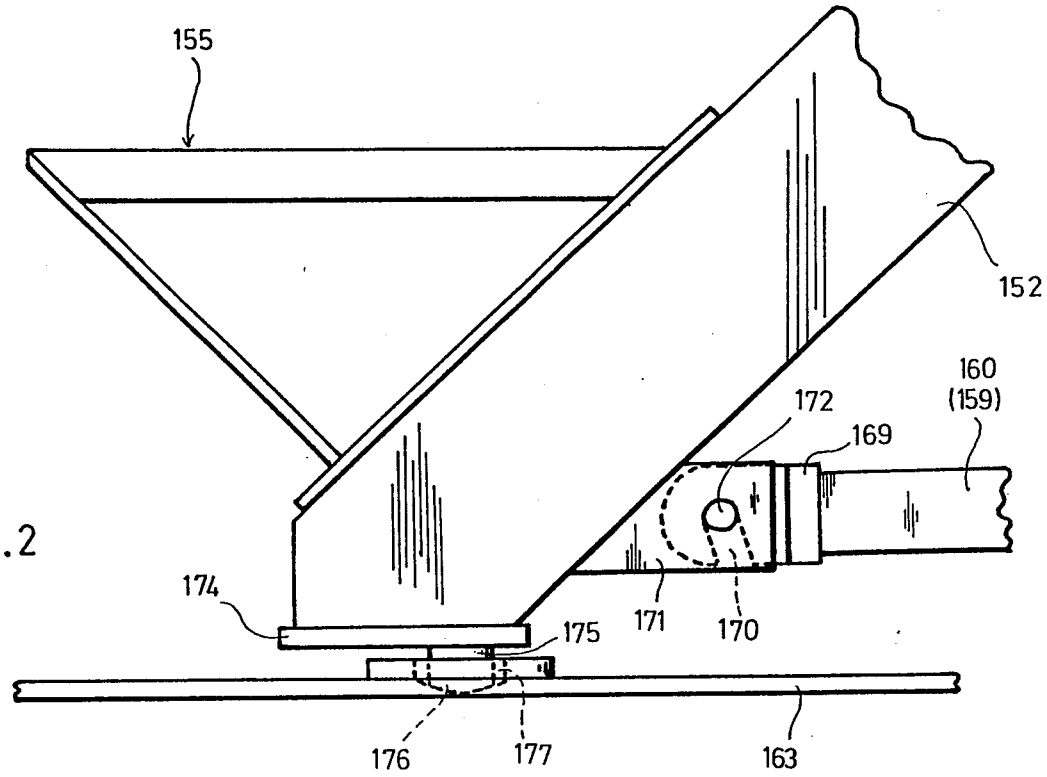
FIG. 2 is a detailed side view of the lower end of the truss member of the assembly.

The coupling between tie bars 159, 160 and the truss section 152 is shown in detail in FIG. 2. The tie bars are of square box section and are welded to a common head 169 which contains a transverse downwardly open, forwardly inclined slot 170. A pair of rearwardly extending spaced parallel plates 171 are welded to the rear of the truss, and these are bridged by a horizontal pin 172. When the staging is in its assembled state as shown, the head 169 is received between the plates with the pin located in slot 170. Because of the rearward inclination of the truss and the forward inclination of the slot the head is held captive between the plates. The tie bars can only be uncoupled from the truss by pivoting the truss about the pin 172 in a vertical plane towards a vertical position and lifting the head 169 with a slight forward movement.

The lower end of the truss is welded to a substantially horizontal bottom plate 174, from which an upright cylindrical foot 175 having a part-spherical lower end 176 projects downwardly to swivellably rest in a well 177 in the respective ground plate 163.

Figure 3:
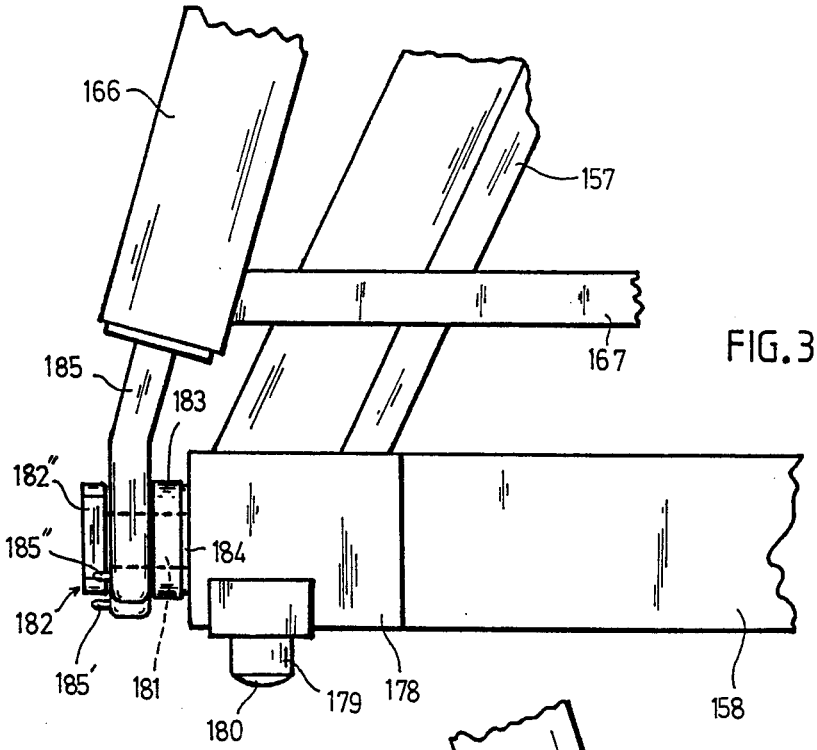
FIGS. 3 and 4 are detailed end and side views respectively of the lower end of one of the support legs for the truss member.
Figure 4:
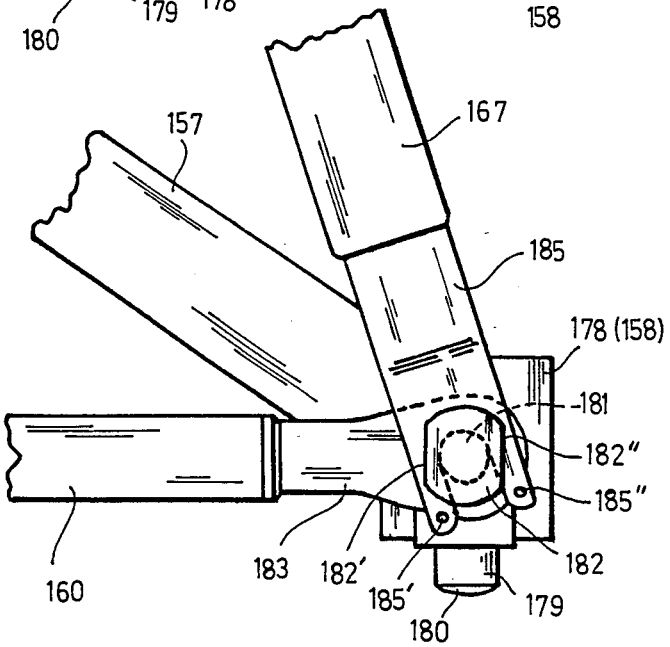

FIGS. 3 and 4 show how the opposite end of tie bar 160 is coupled to the legs 157 and 166. Bracing bar 158 and leg 157 are both of square box section and are both welded to a common block 178. An upright cylindrical foot 179 again having a part-spherical lower end 180 extends downwardly from the block, and a pin 181 having a head 182 extends substantially horizontally from the block in the opposite direction to the bracing bar 158. The tie bar 160 terminates in an eye ring 183 which is held captive on the pin 181 along with a washer 184 which is located between the eye and the block. There is a similar pin and eye arrangement at the opposite end of the bracing bar 158, both pins being axially aligned so that relative pivotal movement can take place between the tie bars 159, 160 and the legs 156, 157 about the axis of pins.

The second pair of legs 165, 166 are also of square box section and each terminates in a downwardly directed fork 185. Each arm of the fork carries at its lower end an outwardly projecting peg 185', 185", and the head 182 has a pair of opposed vertical flats 182', 182". With the rear legs 165, 166 in a substantially vertical position the forks 188 can thus be dropped over the pins 181 between the eyes 183 and pin heads 182, with the flats 182' and 182" passing between the pegs 185' and 185". The rear legs can then be pivoted about the axis of pins 181 into a forwardly inclined operative position so that the forks 185 are held captive on the pins 181 by the pegs 185', 185".

Figure 5:
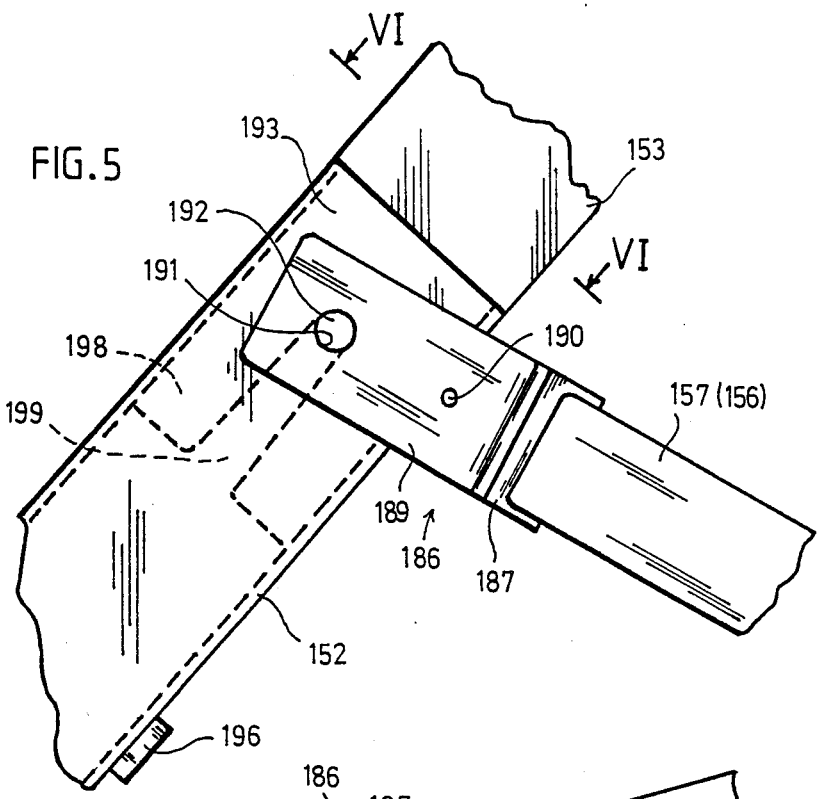
FIG. 5 is a detailed side view of the connection between the support legs and the truss member.
Figure 6:
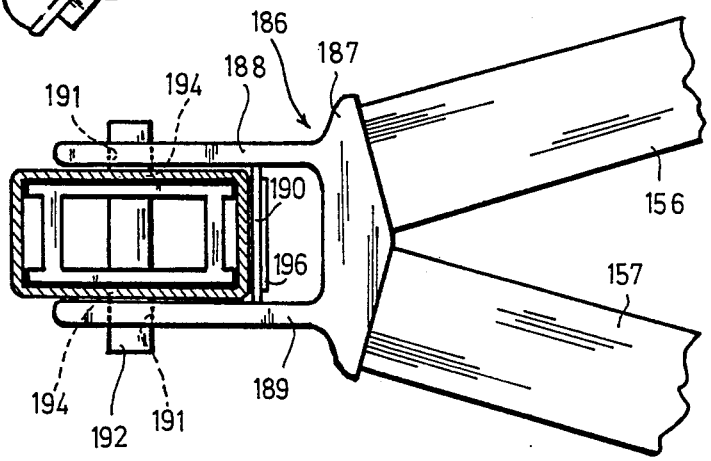
FIG. 6 is section VI—VI of FIG. 5.

FIGS. 5 and 6 show how the first pair of legs 156, 157 are coupled to the lower truss section 152. The upper ends of the legs are welded to a common fork head 186 which comprises a base portion 187 which is joined to the legs, from which two generally parallel spaced arms 188, 189 project away from the legs. Adjacent to their roots the arms are bridged by a small diameter pin 190, and towards their free ends the arms contain aligned holes 191 to receive a fixing pin 192. The upper end of the lower truss section forms an open socket 193 and the opposite side walls of this socket again contain aligned holes 194 (FIG. 6) to receive the fixing pin. Thus, with the socket 193 received between the arms of the fork 186 the fixing pin 192 can be inserted through holes 191 and 194 to connect the fork to the truss.

The lower face of the truss is provided with a stop 196 located a short distance below the socket 193. This is used during erection of the staging, as will be described below. The second pair of legs 165, 166 are connected to upper truss section 153 by a similar pin and fork head arrangement to that just described. Instead of the stop 196 being below the fork head however, a similar stop is provided just above the head. The legs 165, 166 are provided with inwardly directed opposed stop members 201, 202 (FIG. 1) a short distance below the bracing bar 168. These are again used in assembly as described below.

Figure 7:
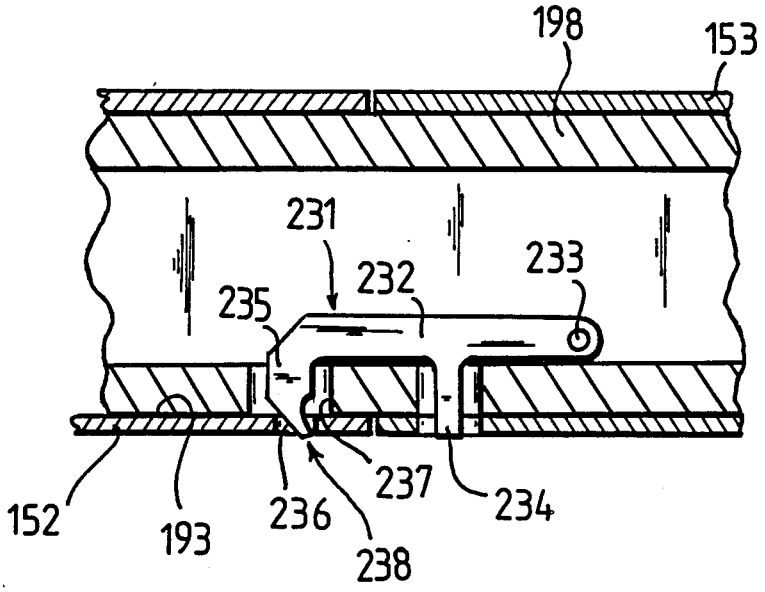
FIG. 7 is a vertical section through the connection of FIG. 5 taken perpendicular to section VI—VI.

Referring to FIG. 5, the lower end of the upper truss section 153 carries an axial spigot 198, which is also of hollow box section. This spigot is a close sliding fit within the socket 193, and includes a transverse slot 199 extending axially from the outer end of the spigot to receive the pin 192. Thus, the spigot can be slid into the socket with the pin 192 in place. For safety purposes a gravity catch is provided to hold the two truss sections together, and this is shown in FIG. 7. The catch 231 is located within the spigot 198 and comprises an arm 232 which is pivoted at one end 233 to lie against the lower wall of the spigot projecting towards the free end of the spigot. Part way along the arm 231 there is secured a release button projects through the bottom wall of the truss section 153, and at the free end of the arm a hook portion 235 having an inclined leading edge 236 projects through an aperture 237 in the wall of the spigot. Thus, as the spigot is inserted into the socket 193 the wall of the socket engages the inclined edge 236 and pivots the catch so that the hook portion retracts into the spigot. However, once the spigot is fully inserted into the socket 193 the hook portion 235 becomes aligned with a hole 238 in the wall of the socket so that the catch is free to return under gravity to the position shown. The hook portion 235 thus prevents the spigot from being withdrawn from the socket 193. The catch can only be released by manually pushing the operating button 234 to pivot the catch to the retracted position.

Figure 8:
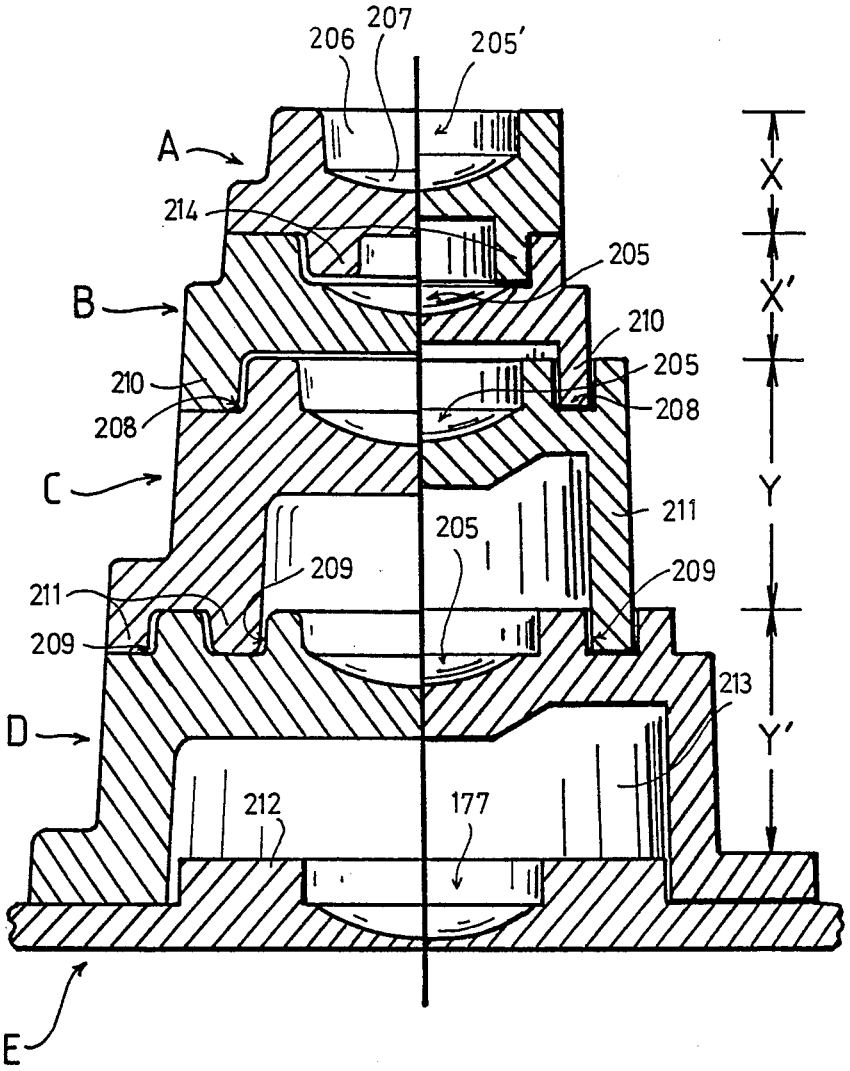
FIG. 8 is a vertical section through a set of spacer cups for use in levelling the truss assembly.

FIG. 8 shows a set of spacer cups for use in levelling the truss assembly should it be required to erect the staging on uneven ground, e.g. a sports field. The left half of the drawing shows the cups as castings whereas the right half shows turned cups. The drawing shows a set of four circular cups A to D which are seated upon each other, the width of the cups generally reducing in diameter from the bottom cup D to the top cup A. The upper face of each cup contains a central well 205 which, apart from cup A, is similar in size to the well formed in ground plates 163, one of which is represented in the drawing as E. Well 205' of cup A is slightly smaller in diameter than those of the other cups, the reason for which will be explained shortly. Each well generally comprises an upright cylindrical side wall 206 which leads into a concave part-spherical bottom wall 207, the radius of curvature of which matches the underside of feet 175 and 179. The upper faces of the two lowermost cups C and D include annular recesses 208, 209 respectively, to receive and laterally locate depending cylindrical spigots 210 211 respectively, provided on the undersurface of cups B and C respectively. Ground plate E has an upstanding collar 212 surrounding its well 177, and the lowermost cup D has a recess 213 in its underside to fit over and laterally locate the cup on the ground plate. The underside of cup A has a central spigot 214 which fits into and provides lateral location in any of the wells 205 of the other four cups or in well 177 of the groundplate.

It will be noted that in cups A and B the respective lift X, X' between the upper surface of the cup and the upper surface of the cup immediately below it is half that of cups C and D, (Y, Y' respectively). The overall lift between the well 205 of the upper cup and the well 177 of ground plate E can be varied by using different combinations of cups. A total of six different lift combinations can be provided using the cups, namely E+A, E+D, E+D+A, E+D+C, E+D+C+B and E+D+C+B+A. Normally two sets of cups will be provided for use with the rear groundplates. On level ground the combination E+D gives the required truss inclination (say 44 degrees) but on uneven ground the truss can be restored to this inclination by changing the cup combination under one or both rear legs as required.

The use of cups of reducing diameter provides stability against sideways loads even where a large lift is required. Furthermore, the configuration of the cups ensures that no cup of greater or the same diameter can be located on top of another. In particular it will be noted that since the well 205' of cup A is smaller than that of the other cups another cup A cannot be located on this cup since its spigot 214 will not fit within the well.

Other lifts can be achieved by using greater numbers of cups and/or different individual lifts. The cast cups could be of any cross section, e.g. square instead of circular.

Figure 9:
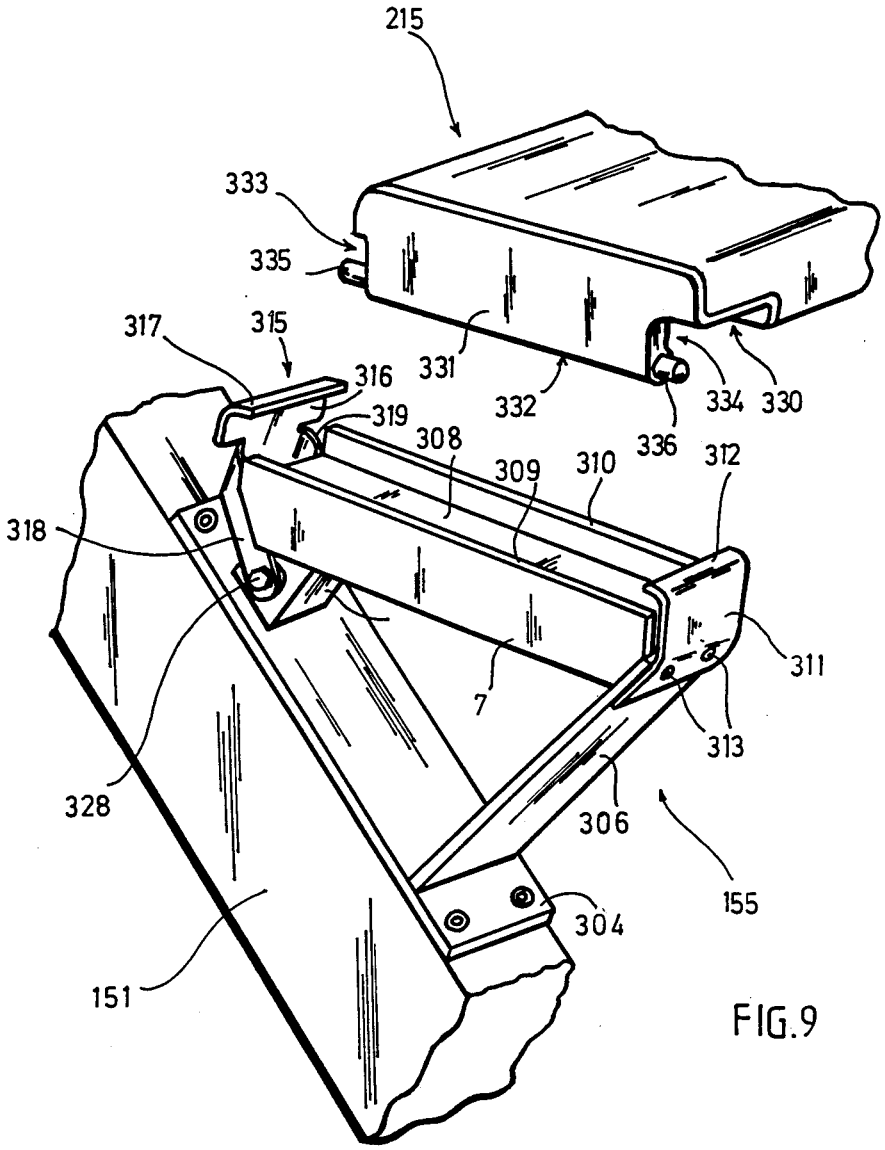
FIG. 9 is a detailed perspective view of a deck support bracket secured to a truss member with the deck shown in a freed position.

Two support assemblies of the kind described above are connected together by a number of decking members which extend transversely between the trusses bridging the corresponding brackets 155 of the two truss members. FIG. 9 shows how each of the decking members 215 is connected to a bracket 155.

The brackets 155 each comprise a rectangular base plate 304 which carries a short rear strut 305 and a longer, forwardly inclined front strut 306. These struts in turn support a substantially horizontal channel member 307 which includes a support platform 308 and upstanding side walls 309, 310 extending along its longer edges. At the front edge of the platform 308 there is an upstanding hook member 311 including a rearwardly projecting limb 312, which is secured to the front strut 306 by screws 313. There is also a second hook member 315 upstanding from the rear edge of the platform. This is formed of sheet metal and includes an upright limb 316 with a limb 317 projecting forwardly from its upper edge. This second hook member 315 is pivotally and resiliently connected to the rear strut 305, as will now be explained.

Figure 10:
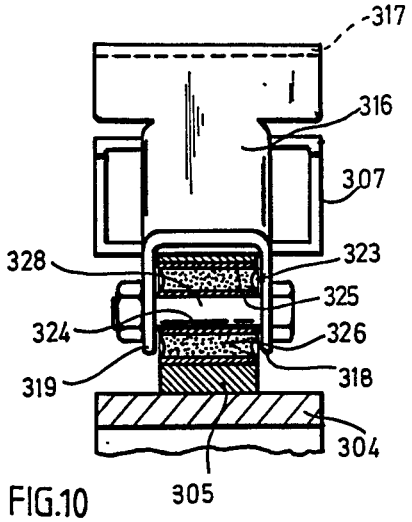
FIG. 10 is a sectional view through a hook member for retaining the deck, taken longitudinally of the deck.

Referring to FIGS. 9 and 10, the second hook member 315 includes a pair of parallel arms 318, 319 projecting forwardly and downwardly from the side edges of the upright limb 316 either side of the rear strut 305. A resilient mounting bush 323 is inserted tightly through the strut 305. This bush comprises inner and outer tubes 324, 325 and these are bonded together by a resilient rubber annulus 326. A bolt 328 inserted through the inner tube 324 and arms 318, 319 clamps the arms to the ends of the inner tube. Thus, if the hook member 315 is pivoted in a rearward direction about the axis of the bolt 328 the rubber annulus is subjected to a shearing deformation which tends to resiliently return the hook member to the original forward position.

Figure 11:
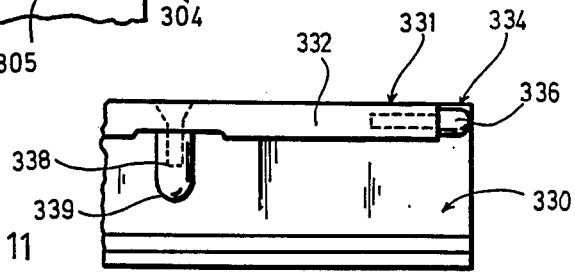
FIG. 11 is an underside view of the deck.

As shown in FIG. 9, the end of the deck member is undercut at 330 and a transverse tongue 331 depends from its extreme end. The lower face 332 of the tongue is convexly curved transverse to its length, and the ends of the tongue are provided with lower recesses 333, 334. A pair of axially aligned locking pins 335, 336 project from each end of the tongue into the respective recesses 333, 334. As shown in FIG. 11, a pivot abutment 338 is secured to the inner face of the tongue 331 half way along its length, and its inner end 339 is rounded for reasons which will be explained below.

Figure 12:
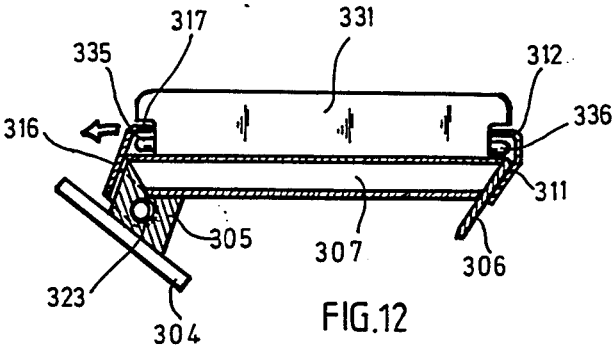
FIG. 12 is a sectional view of the assembly with the deck in place and seen in end view.

To couple the deck 215 to the support bracket 155 the deck is inclined slightly in a forward direction and the rearmost retaining pin 335 is located beneath the limb 317 of pivoted hook member 315. The deck is then moved rearwardly to rotate the hook member 315 against the resilience of the annulus 326 until the front pin 336 is rearward of the fixed hook member 311. The front edge of the deck is then lowered until the tongue rests upon the platform 308. The deck is then moved forwardly so that the pin 336 engages beneath the limb 312 of the fixed hook member and the pivoted hook member returns to the starting position, as shown in FIG. 12. The pins 335, 336 are thus engaged by the hook members 311, 315 to prevent the deck from being lifted out of the channel member 307. The hook members also locate the deck in a lateral direction, and the deck is located in a longitudinal direction by the side wall 310 of the channel member which is received between the abutment 338 and the end of the decking member.

Figure 13:
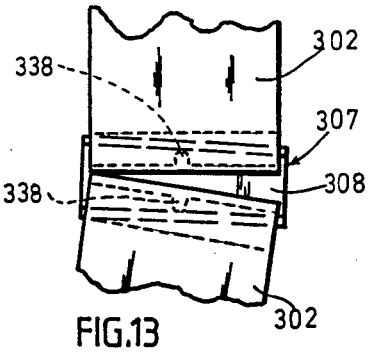
FIG. 13 is a diagrammatic plan view of two decks coupled to the assembly.

Although the deck is securely attached to the support bracket 155 it is still capable of plus or minus 15 degrees or so of angular movement in a vertical plane about an axis which is substantially coincident with the axis of pins 335 and 336. Moreover, the channel member 308 is wide enough to permit the deck plus or minus 7 degrees or so of angular movement in a horizontal plane about the abutment 338, the rounded inner end of which rolls on the inner surface of side wall 310. In fact, as mentioned above, the channel member can receive the tongues of two such decking members 215 extending in opposite directions, as shown in FIG. 13.

The decks are removed in the reverse sequence to that in which they are fitted.

The resilient bush 323 could be replaced by other resilient means such as a rubber block located between the upright limb 316 and the strut 305, or by a suitably arranged torsion, compression or tension spring.

Figure 14:
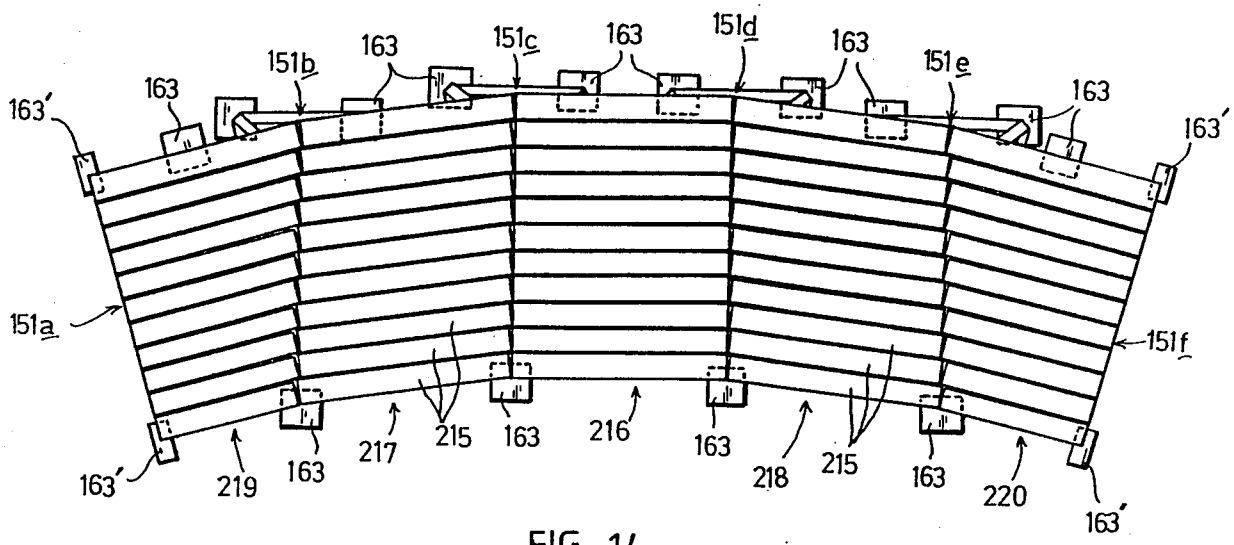
FIG. 14 is a plan view of photographic staging incorporating several truss assemblies.

FIG. 14 shows how six truss assemblies for example can be used in staging for use in group photography. Each adjacent pair of trusses 151*a–f* are connected together by a number of decking members 215 each joining the corresponding brackets 155 of the two trusses. Thus, when upwards of three trusses are used the staging can be curved into an arc as shown. The decking members of the central staging section 216 are the same length as those of the two adjacent sections 217, 218 but the trusses 151*b* and 151*e* are brought forward relative to trusses 151*c* and 151*d* so that the four inner trusses remain substantially parallel. Although the rear decking members of the outer sections 219, 220 are the same length as those of the other sections, the remaining decking members decrease in length from back to front so that the end trusses 151*a* and *f* are radially aligned with the camera. In addition, the support structures for the end trusses are asymmetric so that the outermost support legs are vertical and do not project beyond the end trusses where they would be in camera shot. Narrower ground plates 163' may also be used with the outer trusses, as shown. Apart from this the end truss assemblies are as described above.

Figure 15:
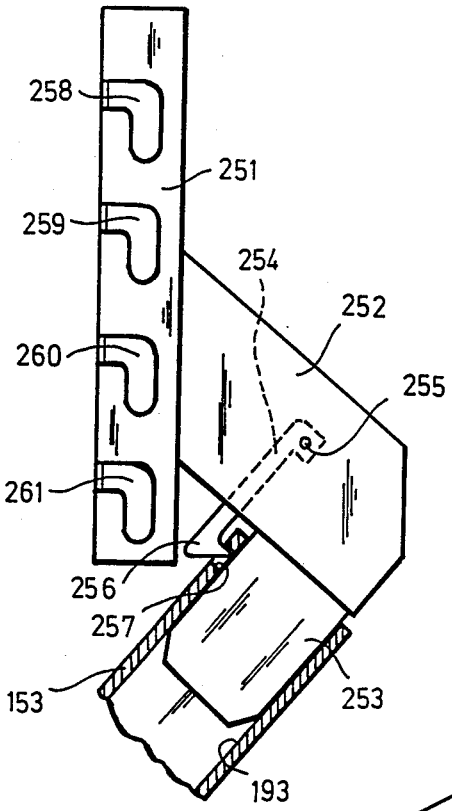
FIG. 15 is a side view of a rear baluster secured to a truss member.

For safety purposed balustrading is provided along the rear and sides of the staging, and this will now be described in detail. The rear balustrading comprises a number of upright balusters 251 (see FIG. 15). Each baluster is formed by a box-section post having a box-section prop 252 extending from part way along its rear face in a downwardly inclined position. A tongue 253 projects substantially perpendicularly from the lower end of the prop 252 in a forward direction for reception in a socket 193 formed by the open upper end of a respective truss member 153.

A catch 254 projects through the front face of the prop 252. The rear end of the catch is pivoted about a hirozontal pivot 255 internally of the prop whereas the front end of the catch has a downwardly directed hook 256 for reception in a hole 257 towards the top of the upper face of the truss member 153. The leading end of the hook is inclined so that as the tongue 253 in inserted into the socket 193 the hook rides over the top face of the truss member but eventually drops by gravity into the hole 257, thereby locking the baluster to the truss member. To remove the baluster the catch is simply lifted by hand allowing the tongue to be slid out.

Figure 16:
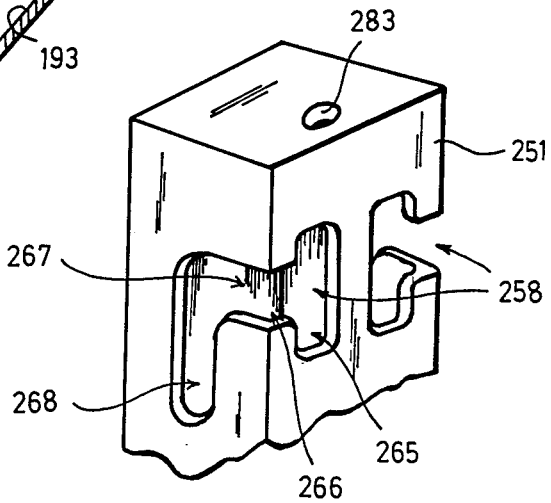
FIG. 16 is a perspective view of the top end of the baluster of FIG. 15.
Figure 17:
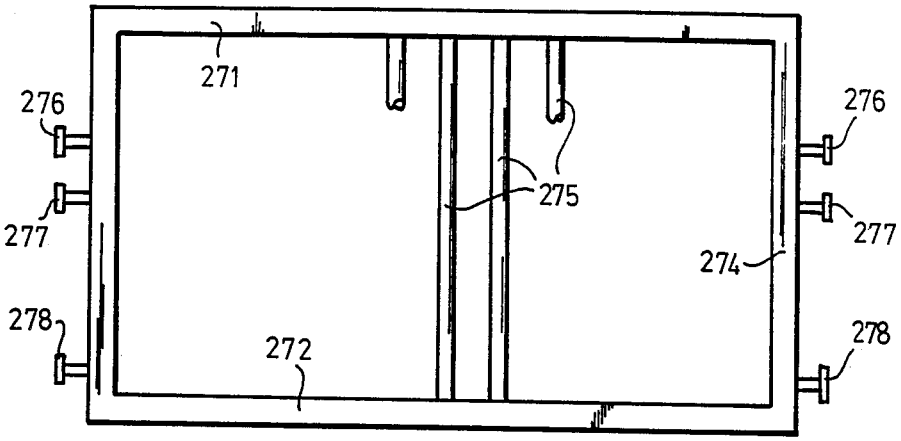
FIG. 17 is a front view of a balustrade panel for use with the rear balusters.

At intervals along the length of the baluster there are formed pairs of substantially identical apertures 258–261. The shape of these is best shown in FIG. 16. Each aperture comprises a head portion 265 in the front wall of the baluster, from the side of which a neck portion 266 leads to the adjacent side wall. The aperture continues in the adjacent side wall in a horizontal portion 267 which ends in a depending portion 268. A balustrade panel can be secured between each adjacent pair of balusters by means of these apertures, and one such panel is shown in FIG. 17.

Figure 18:
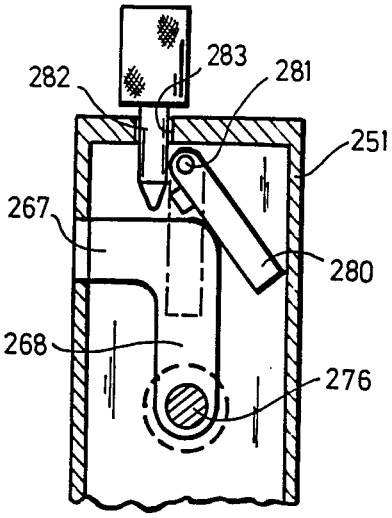
FIG. 18 is a longitudinal section through the top end of the baluster of FIGS. 15 and 16.

The comprises parallel upper and lower horizontal rail members 271, 272 joined at their ends by uprights 273, 274 and at spaced intervals by vertical bars 275. (Some of the bars 275 have been omitted for convenience of illustration.) Each upright 273, 274 has three vertically spaced headed pins 276–278 projecting from its outer face for reception in the apertures 258–261. The head of the pin is passed through the head portion 265 of the respective aperture and is then moved rearwardly until the neck of the pin can drop down the depending portion 268. Since the head is too large to pass through the depending portion of the aperture the panel is firmly held in position. However, as an added safeguard agains the panel being inadvertently lifted and coming free from the balusters a safety catch may be mounted in the upper ends of the balusters as shown in FIG. 18. This catch comprises a depending plate 280 which is freely pivoted about a horizontal pivot 281 at its upper end immediately above the depending portion 268 of the top aperture. As the respective pin 276 is inserted into the aperture the plate is pivoted rearwardly by the pin. However, once the pin drops into place the plate is free to pivot back to a vertical position under gravity so that its lower end lies immediately above the pin as shown in dashed outline, to prevent the pin from lifting. To remove the panel a special tool 282 is inserted into a hole 283 in the top wall of the baluster to pivot the plate 280 out of engagement with the pin.

Each baluster can have a balustrade panel secured at each side so that a continuous balustrade formed of alternating panels and supporting balusters can be provided along the rear of the staging.

With the arrangement of pins and apertures shown, each balustrade panel can be secured at any one of three different heights. In its heighest position pins 277 and 278 are inserted in apertures 258 and 260 respectively of each baluster. In the intermediate position pins 276, 277 and 278 are inserted in apertures 258, 259 and 261 respectively. To achieve the lowest position the panel is inverted and pins 278, 277 and 276 are inserted in apertures 258, 260 and 261 respectively.

Figure 19:
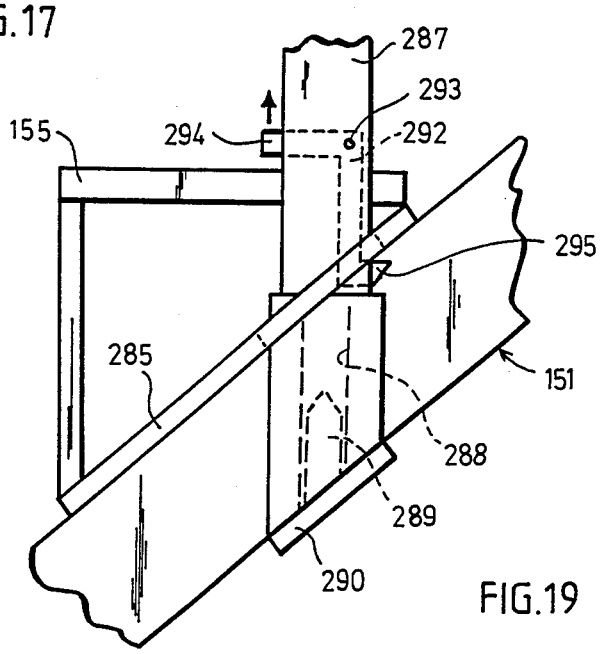
FIG. 19 is a side view of a side baluster secured to a side truss member.
Figure 20:
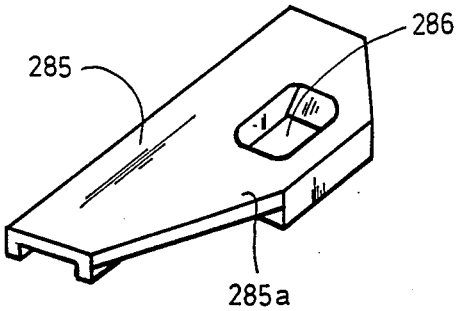
FIG. 20 is a perspective view of the top mounting bracket for the baluster of FIG. 5.

In order to provide balustrading along the side ends of the staging a similar series of balusters can be secured in an upright position to each end truss member in the manner shown in FIGS. 19 and 20. The mounting plates 285 for the deck support brackets 15, which are secured at intervals along the length of the truss member, are each extended laterally to the outside of the staging. The extended portion 285*a* (FIG. 20) of the mounting plate contains an aperture 286 to receive the lower end of a side baluster 287 (FIG. 19) alongside the truss member. The bottom of each side baluster 287 contains a socket 288 for reception of a locating pin 289 which is upstanding from a lower plate 290 which extends laterally from the lower face of the truss member vertically below the mounting plate 285.

In order to secure the side balusters in the apertures 286 each baluster contains a lazy-Z shaped catch 292 which is pivoted about a horizontal axis 293. The upper end 294 of the catch projects from the front face of the baluster. The lower end 295 projects from the rear face of the baluster and its lower edge is inclined as shown so that as the baluster drops into the apertire 286 the catch rotates in a clockwise direction, when viewed as in the drawing. When the baluster is fully seated on the pin 289 the catch is free to return under gravity to the position shown so that the lower end 295 locates beneath the plate 285. To remove the baluster the front end 294 of the catch is manually lifted to pivot the catch and withdraw the lower end 295.

Figure 21:
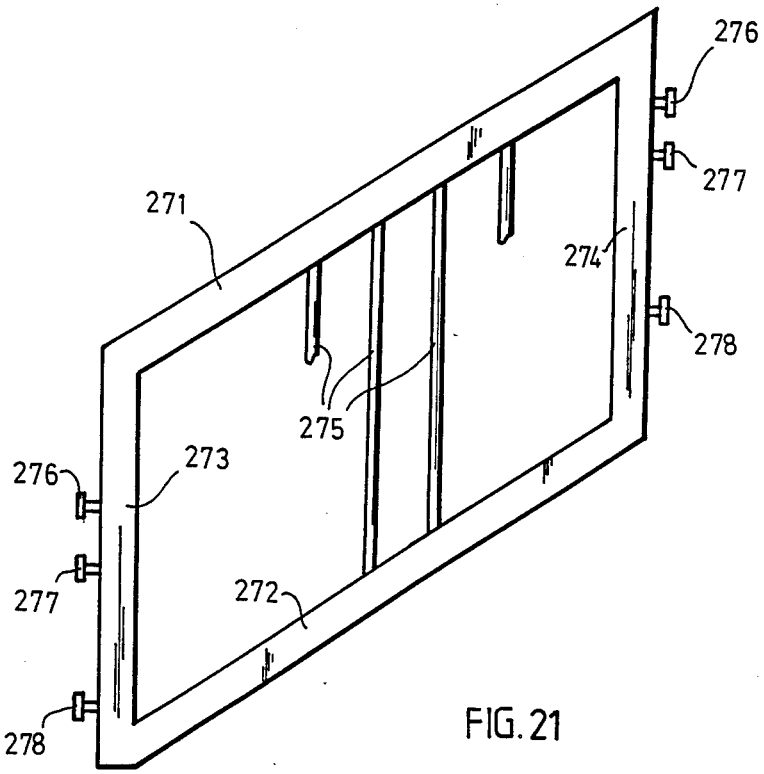
FIG. 21 is a side view of a balustrade panel for use with the side balusters.

Although not shown, the side balusters are provided with similar pairs of holes to the rear balusters, enabling side panels to be mounted between each pair of balusters extending longitudinally of the end truss members. The side panels (FIG. 21) are of the same construction as the rear panels except that they are in the shape of a parallelogram.

The balustrading panels could have horizontal bars or wire mesh in place of the upright bars.

The main structural members of the truss assemblies are all of lightweight metal for ease of transportation and handling.

Figure 22A:
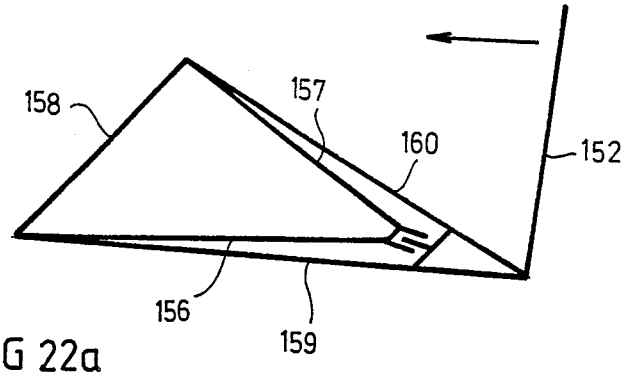
FIGS. 22*a–e* are skeletal perspective views showing various stages in the erection of each truss assembly.
Figure 22B:
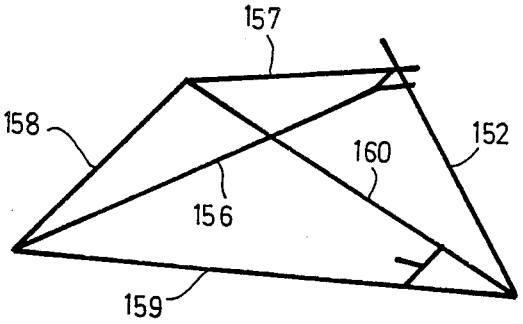

FIGS. 22*a–e* show the sequence in which each truss is erected. First, the tie bars 159, 160 with legs 156, 157 attached are laid on the ground in the required position. As shown, the legs are held in a common plane with the tie bars during storage and transport by means of pin 192 which is inserted through the fork head 186 and apertured plate 162. The lower truss section 152 is then coupled with head 169 of the tie bars by dropping the head onto the pin 172 with the truss section in a near-vertical or forwardly inclined position, and then pivoting the truss section 152 in a vertical plane towards its normal rearwardly inclined position. The pin 192 is then withdrawn so that the legs can be lifted. If required, the pin 190 of the fork head can be temporarily rested on stop 196 at this stage, as shown in FIG. 22*b*. The legs are then lifted so that the fork head slides along the truss section 152 until the pin apertures 191 of the head are in register with apertures 194 of the socket portion 193, whereupon the pin 192 is inserted therethrough. Some of the decking members can now be added to ensure the correct spacing of the trusses. In addition, gauge bars can be temporarily fitted between adjacent trusses at say the first and fifth row levels to assist in obtaining the correct truss spacing. If five row staging is required all the decks can be added to complete the assembly of the staging.

Figure 22C:
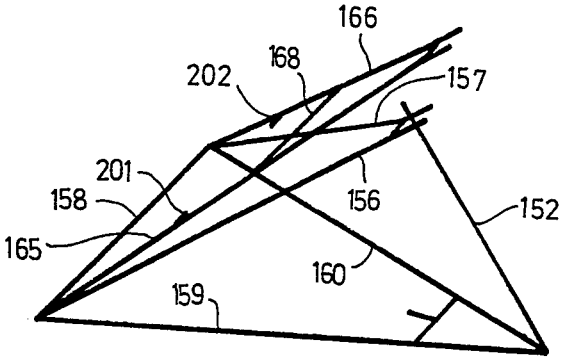
Figure 22D:
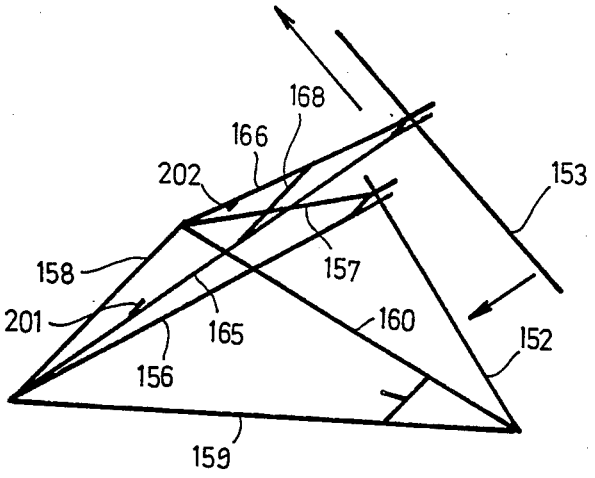
Figure 22E:
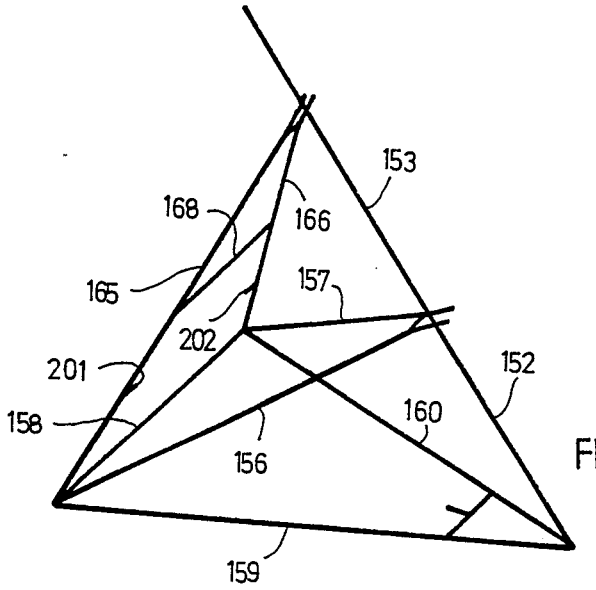

If eleven row staging is required the rear legs 165, 166 are added by dropping the forks 185 onto pins 181 as described. The stops 201 and 202 can now rest on the first legs 156, 157 as shown in FIG. 22*c* so that the fork head 186 of the rear legs is raised slightly above that of the front legs. The fork head of the rear legs is the connected to the upper truss section 153 by the respective pin 192 (FIG. 22*d*). The upper stop 196 allows the truss to be temporarily rested on the pin 190 of the upper fork head using this stop before the fixing pin is inserted. The lower end of section 153 is then grasped and pushed upwards to enable the spigot 198 to be slid into the socket 193 of the bottom truss section (FIG. 22*e*). Finally the remaining decking members can be added.

Any levelling of the truss assemblies that may be required can be carried out at any stage before the decks are added. The staging is dismantled in the opposite sequence to which it is erected.

The upper truss sections 153 may be in two or more sections, for example a middle four row section joined to an upper two row section by a spigot and socket joint just above the upper fork head 186. Thus, seven row staging could be made by adding the two row extension to the basic five row section, or nine rows by omitting the top two row section. Smaller five or seven row staging could be constructed using this same principle, the only difference being that the inclination of the single pair of supporting legs would be closer to that of the rear legs 165, 166.

I claim:

1. Staging comprising:

a pair of mutually spaced support assemblies, each support assembly comprising, a truss member having front and rear ends, a first pair of legs arranged in an inverted-V configuration to support said truss member with a rearward inclination, upwardly, each leg of said first pair of legs having upper and lower ends, first connection means positively connecting said first pair of legs to said truss member to prevent movement of said legs longitudinally of said truss member, bracing means for determining the spacing of said lower ends of said first pair of legs, and a pair of tie bars each linking said lower end of a respective leg of said first pair of legs with said front end of said truss member; and a plurality of decking members bridging said truss members of said support assemblies in a stepped configuration.

2. Staging as claimed in claim 1 wherein:

said lower ends of said first pair of legs are connected to said tie bars by second connection means which provides for relative pivotal movement between said legs and said tie bars about a substantially horizontal pivot axis.

3. Staging as claimed in claim 2 wherein:

said second connection means between said first pair of legs and said tie bars is non-releasable.

4. Staging as claimed in claim 1 wherein:

said front end of said truss member is connected to said tie bars by third connection means which provides for relative pivotal movement between said truss member and said tie bars.

5. Staging as claimed in claim 1 wherein:

said first connection means comprises a fork head secured to said first pair of legs and including aligned apertures, and a fixing pin for insertion through said aligned apertures of said fork head and through aligned apertures in said truss member.

6. Staging as claimed in claim 1 wherein:

said first connection means is releasable;

said bracing means is permanemetly connected to said first pair of legs;

said lower ends of said first pair of legs are connected to said tie bars by second connection means which provides for relative pivotal movement between said legs and said tie bars about a substantially horizontal pivot axis, said second connection means being non-releasable; and said front end of said truss member is connected to said tie bars by third connection means which provides for relative pivotal movement between said truss member and said tie bars, said third connection means being releasable.

7. Staging as claimed in claim 1 wherein:

said truss member comprises an upper portion adjacent to said rear end of said truss member;

said support assembly comprises a second pair of legs arranged in an inverted-V configuration to support said upper portion of said truss member, each leg of said second pair of legs having upper and lower ends, and fourth connection means connecting said second pair of legs to said lower ends of said first pair of legs.

8. Staging as claimed in claim 7 wherein:

said fourth connection means provides for relative pivotal movement between said first and second pairs of legs about a substantially horizontal pivot axis.

9. Staging as claimed in claim 7 wherein:

said fourth connection means is releasable.

10. Staging comprising;

a pair of mutually spaced truss members;

means for supporting said truss members with a rearward inclination, upwardly;

a plurality of decking support members secured to each of said truss members at spaced positions along the length thereof;

a plurality of decking members bridging said truss members in a stepped configuration, each decking member having opposite end portions, and each of said end portions being seated upon one of said decking support members;

fifth connection means positively connecting said end portion of said decking member with said support portion, said fifth connection means comprising a hook member secured to one of said end portion and said support portion, said hook member including a limb projecting transversely of said decking member, and an engaging portion associated with the other of said support portion and said end portion, the arrangement being such that said engaging portion engages said limb of said hook member to limit lifting of the decking member in an upward direction.

11. Staging as claimed in claim 10 wherein:

said fifth connection means comprises two such hook portions spaced transversely of said respective decking member, and two such engaging portions for cooperation with said hook portions.

12. Staging as claimed in claim 11 wherein:

said engaging portions comprise pins projecting in opposite directions transversely of said decking member, and said hook portions are secured to said support portion with said limbs of said hook portions projecting towards each other.

13. Staging as claimed in claim 12 wherein:

one of said hook portions is resiliently biassed towards the other of said hook portions by resilient bias means.

14. Staging as claimed in claim 10 wherein:

said end portion of said decking member comprises a depending tongue, and said support portion comprises an upwardly open channel member for receiving said tongue.

* * * * *